United States Patent [19]

Davis et al.

[11] 4,228,753

[45] Oct. 21, 1980

[54] FLUIDIC CONTROLLED DIFFUSERS FOR TURBOPUMPS

[75] Inventors: Sydney Davis, Silver Spring, Md.; John M. Durkin, Vienna, Va.

[73] Assignee: The United States of America as represented by the Secretary of the Navy, Washington, D.C.

[21] Appl. No.: 15,675

[22] Filed: Feb. 27, 1979

[51] Int. Cl.[3] ..... B63B 1/38; F03B 3/18; F04D 29/68

[52] U.S. Cl. ..... 114/67 A; 180/118; 415/48; 415/115; 415/211; 415/DIG. 1

[58] Field of Search ..... 114/67 R, 67 A; 180/117-120; 415/115, 207, 211, 26, 48, DIG. 1, 17, 26, 69; 244/207, 203, 90 B

[56] References Cited

U.S. PATENT DOCUMENTS

| | | | |
|---|---|---|---|
| 2,084,463 | 6/1937 | Stalker | 415/69 |
| 2,920,813 | 1/1960 | Goldschmied | 415/DIG. 1 |
| 3,016,213 | 1/1962 | Griswold | 244/207 |
| 3,237,850 | 3/1966 | Troller | 415/DIG. 1 |
| 3,424,266 | 1/1969 | Cockerell | 180/118 |
| 3,446,224 | 5/1969 | Zwicky, Jr. | 415/26 |
| 3,889,775 | 6/1967 | Luscher | 180/118 |
| 3,941,335 | 3/1976 | Viets | 244/203 |

*Primary Examiner*—Sherman D. Basinger

*Attorney, Agent, or Firm*—R. S. Sciascia; Sol Sheinbein; K. E. Walden

[57] ABSTRACT

An arrangement for controlling the apparent curvature of diffuser vanes of a turbine fan to reduce stalling of the vanes and increase efficiency of the fan output over a wider range of flow demand. Sensors responsive to pressure on opposite sides of the vanes selectively control the discharge of pressurized fluid from the diffuser vanes to effect their apparent curvature changes. The arrangement has particular use in a ride control system for surface effect ships.

4 Claims, 8 Drawing Figures

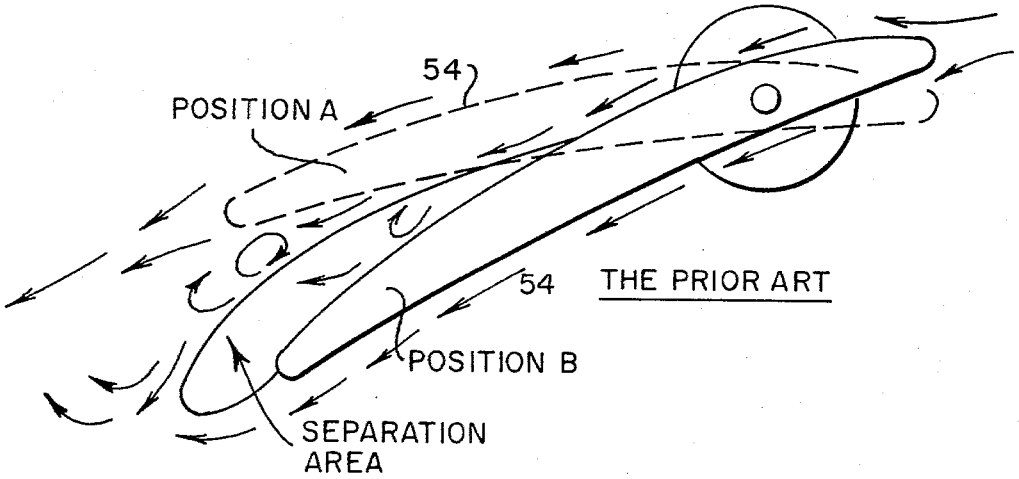
FIG. 6
FIG. 7
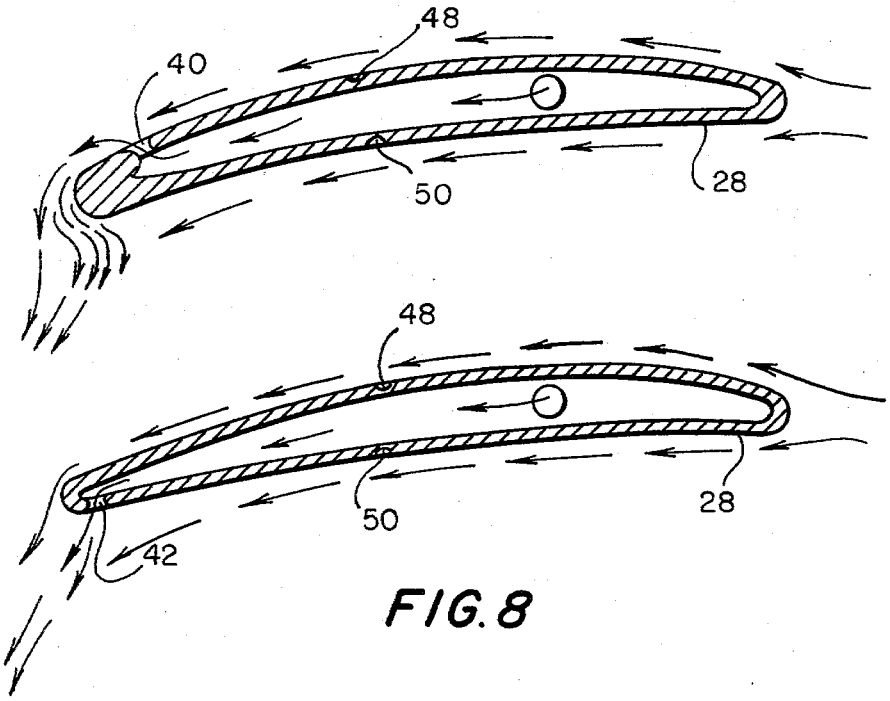
FIG. 8

FLUIDIC CONTROLLED DIFFUSERS FOR TURBOPUMPS

The invention described herein may be manufactured and used by or for the Government of the United States of America for governmental purposes without the payment of any royalties thereon or therefore.

BACKGROUND OF THE INVENTION

1. Field of the Invention

The invention relates generally to controlling the apparent curvature of turbine fan diffuser vanes to fan air flow by selective discharge of pressurized fluid, such as compressed air, from the surface thereof to prevent stalling of the vanes over a wider range of fan output than is possible with presently known mechanical adjustments. It has use in ride control systems for surface effect ships.

2. Brief Description of the Prior Art

It is known in the prior art to angularly adjust diffusers on the discharge side of centrifugal fans to maintain efficiency over a wide range of operating conditions. Examples of mechanically adjusted diffusers are taught, for example, in U.S. Pat. Nos. 2,341,974; 2,797,858; 2,985,427; and 3,957,392.

It is also known in the prior art to vary the physical shape of diffuser vanes in centrifugal compressors by admitting pressure to inside the vane, thus employing the principle of the Bordon tube. This is taught in U.S. Pat. No. 2,323,941. An arrangement employing boundary layer control over diffuser vanes is disclosed in U.S. Pat. No. 2,084,463 where downstream air is directed to and discharged from the surface of diffuser vanes located upstream. U.S. Pat. No. 3,172,495 illustrates the use of air discharge from airfoil members to laterally deflect a moving stream of air. Circulation of air over a wing surface involving the Coanda effect for lift control is shown in U.S. Pat. Nos. 3,016,213 and 3,830,450.

In U.S. Pat. No. 2,830,754 there is taught in the axial compressor art the reverse flow of a small quantity of pressurized air from hollow stator vanes in a high pressure section of the compressor to hollow stator vanes in a lower pressure section. From there it is discharged to the surface of the vane so as to control the direction of flow of the compressed air to the next row of rotor vanes.

SUMMARY OF THE INVENTION

This invention concerns optimum output efficiency of turbine fans over a wide range of flow demand and is particularly adaptable to the efficient handling of a continually changing fan flow rate into a surface effect ship plenum chamber. It is directed to control of the apparent and thus the effective curvature of diffuser vanes located in cascade on the discharge side of a fan rotor for converting velocity head to static pressure. Pressurized fluid, such as compressed air, from an independent source is passed through hollow fixed diffuser vanes and discharged from openings in their surfaces in a manner to change the apparent curvature of the fixed vanes to prevent their stalling over wide flow demands. The volume of compressed air admitted to the vanes is selectively controlled by sensors responsive to (1) air pressure on opposite sides of the diffuser vanes, (2) pressure in the air cushion beneath the surface ship or (3) a vertical acceleration of the ship.

BRIEF DESCRIPTION OF THE DRAWINGS

FIG. 6 illustrates a mechanically adjustable diffuser vane in two operative positions.

FIG. 7 is a cross-section view illustrating one form of hollow diffuser vanes of the present invention.

FIG. 8 is a cross-sectional view illustrating another form of diffuser vane of the present invention.

DESCRIPTION OF THE PREFERRED EMBODIMENT

Figure 1:
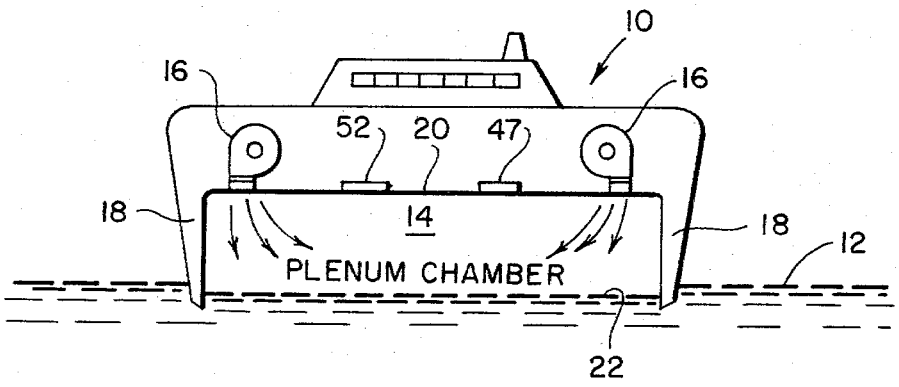
FIG. 1 is an end representation of a surface effect ship on cushion.

In FIG. 1 there is illustrated in bow or stern view the outline of a surface effect ship 10 supported at least partially over water 12 on a cushion of pressurized air contained in plenum chamber 14. A plurality of fans 16, of a type to which the present invention is adaptable, continually supplies air at moderate pressure of around 100—120 psf to plenum 14 to support the ship on cushion as shown. In this "on cushion" position, there is only minimal drag, especially at high surface speeds.

Figure 2:
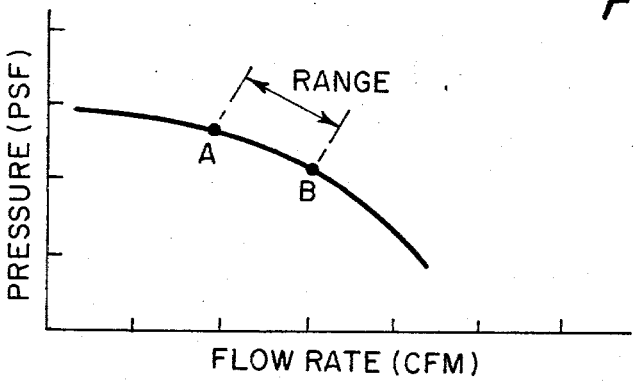
FIG. 2 is a graph of pressure versus flow rate illustrating a varied range over which turbine fans for surface effect ships are required to operate.

Air is continually supplied to the plenum by fans for maintaining the pressurized cushion beneath the ship. The plenum is defined by rigid sidewalls 18, extending longitudinally along both sides, and flexible seals at the bow and stern. The bow and stern seals in the form of inflatable air bags or flexible skirts, held in outward expansion by the pressure within the air cushion, are responsive to waves and swells on the surface of the water and conform thereto with only minimal loss of cushion air. The pressurized cushion is maintained with minimal air loss because the seals snap back to their normal position as soon as the wave is passed. The volume of the pressurized cushion, as illustrated in FIG. 1, is constantly changing due to the passage therethrough of waves and normal pitch, roll and vertical displacement of the craft relative to the water level. Thus, when the cushion is momentarily reduced in volume due to ship motion, the pressure increases, and vice versa. Also, cushion pressure may be lost when a seal or portion of a sidewall looses momentary contact with the water surface. Flow demands on the fan are constantly changing, and to help the fan meet these demands a variable throat may be designed into the fan housing inlet. It opens or closes a predetermined amount in response to the need for more or less air flow to the cushion. A fan used in air cushion vehicles is required to operate over a considerable output range as illustrated by the graph in FIG. 2. The volume of air flowing from the fan varies from instant to instant to meet cushion demands for proper ride control. This requirement is independent of whether the fan is constant or variable speed, or whether it has fixed or variable inlets.

Figure 3:
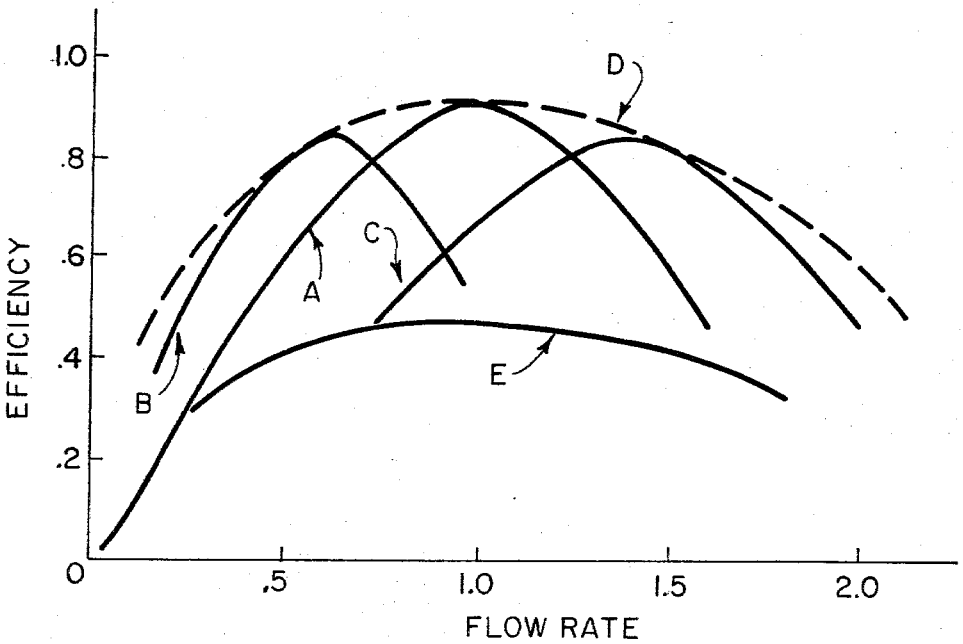
FIG. 3 shows several graphs each illustrating a particular fan design.

Centrifugal fans are often provided with a cascade of air diffuser vanes about the diffuser for greater efficiency. Such vanes may be flat or curved in cross-section and may be fixed or pivotly mounted on the housing. With fixed vanes, the fan is efficient over a relatively narrow rate of flow. This is illustrated in the graphs of FIG. 3 where for example, line A represents the characteristics of a fan being about 85% efficient at one flow rate. Similarly, lines B and C represent fans having their highest output efficiency at other flow rates. Fans with fixed diffuser vanes become relatively inefficient when called upon to meet a flow rate outside of their specific design points. Line D in FIG. 3 illustrates a fan with controllable diffusers for producing a relatively highly efficient response over a wide range of flow. The efficiency of a fan without diffusers is represented by a relatively flat curve such as shown by line E.

The present invention is directed to means for controlling the efficiency of the diffuser vanes about a rotor in response to conditions which include (1) stalling on the diffuser blades, (2) pressure in the plenum chamber or (3) vertical acceleration of a craft, which is an early indication of impending plenum pressure changes and attendant flow demands.

Figure 4:
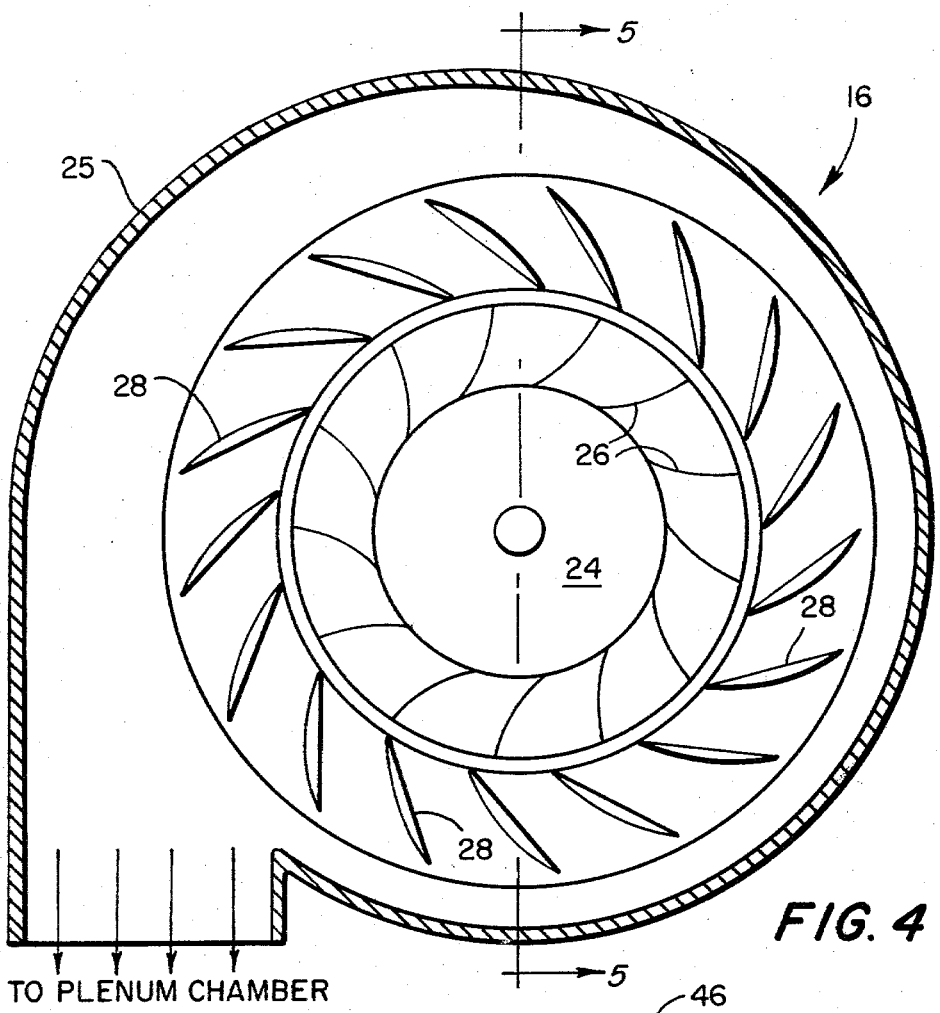
FIG. 4 is an axial view of a turbine fan showing diffuser vanes to which the invention pertains.

There is shown in FIG. 4 an end view of centrifugal fans 16 having a rotor 24 with vanes 26 and housing 25. A cascade of fixed diffuser vanes 28, of a type to be described in detail, are disposed radially of the rotor for aiding the conversion of air velocity head to static pressure.

Figure 5:
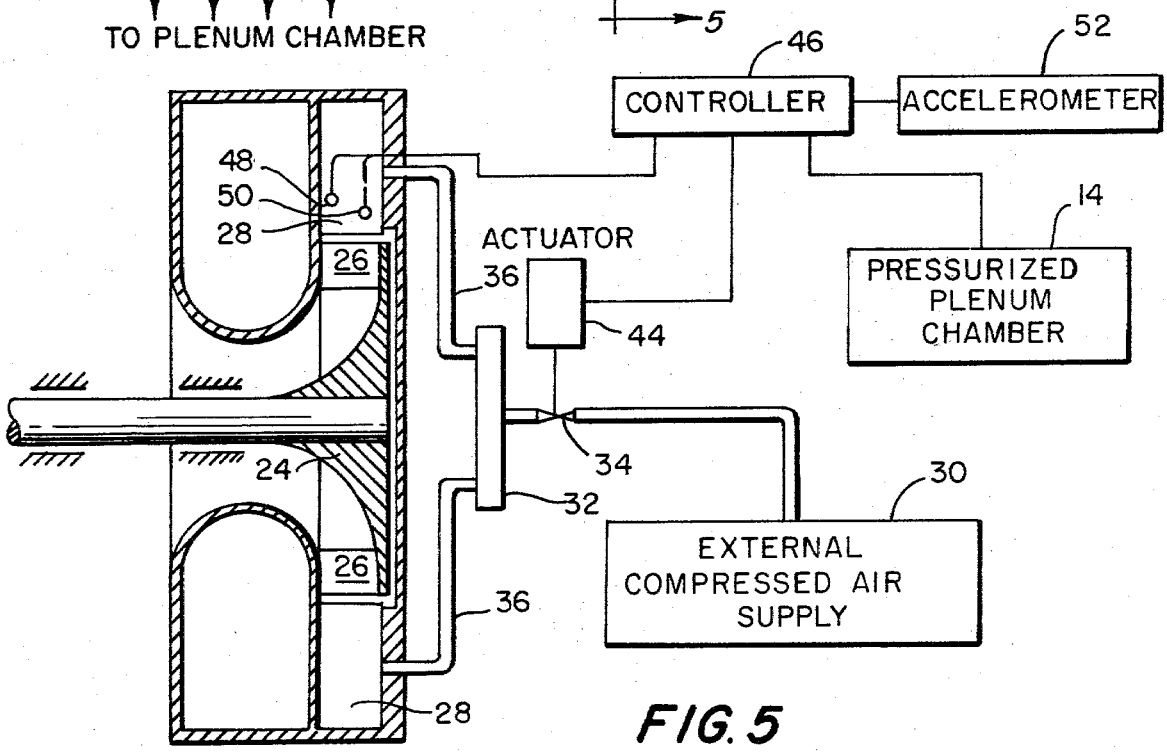
FIG. 5 is a cross-section view of FIG. 4 taken generally along line 5—5 and showing some of the controls therefor.

FIG. 5 is a cross-sectional view taken generally along line 5—5 of FIG. 4 where like numerals are applied to the same elements. Vanes 28 are disclosed in more detail in FIGS. 7 and 8, where they are shown to be hollow with openings to their periphery for discharge of compressed air. As shown in FIG. 5, pressurized fluid, such as compressed air, from an external source 30 is supplied through control valve 34 to manifold 32, from which it is distributed through a plurality of lines 36 to each of the numerous diffuser vanes 28. Pressurized fluid enters the ends of hollow vanes 28 and is discharged at their surfaces through longitudinal slots as illustrated by the numeral 40 and 42, respectively, in FIGS. 7 and 8. The position of control valve 34 is determined by actuator 44 under the command of controller 46.

Controller 46 is adapted to sense conditions at one of the three locations and transmit that information to actuator 44, which, in turn, controls the flow rate of compressed air through valve 34. Controller 46, in one arrangement, is adapted to read pressure on the faces of vanes 28 at locations indicated by numerals 48 and 50 in FIGS. 7 and 8 for an early indication of air separation which indicates that the air flow around the diffuser vanes is disturbed and that the vanes are not of the desired curvature for efficiently handling that flow rate. This information is fed to controller 46 which through actuator 44 throttles valve 34 for admitting more or less compressed air to the vanes to establish an apparent curvature change. Controller 46 is also adapted to sense instantaneous cushion pressure within plenum chamber 14. Upon detection of abnormally high or low pressure in the plenum at location 47, it is known that a flow rate change will be required from the fan to restore conditions. Therefore, actuator 44 will throttle valve 34 to permit the appropriate amount of compressed air to flow to hollow diffuser vanes 28 for effecting apparent curvature of the vanes to attain the highest efficiency in handling that amount of air. Furthermore, controller 46 may sense further air flow demands for fan 16 by reading conditions in a vertical accelerometer 52, which is merely an early indication of pressure change in the plenum, and respond by adjusting the diffusers to accept that demanded air flow rate. If the accelerometer shows, for example, that the surface effect ship is accelerating upwardly, as in a heave or pitch, it is known that the pressure in the plenum chamber will drop and that greater flow output will be required of the fan to dampen the downward cycle. Again, the appropriate amount of pressurized fluid or air is discharged from the diffuser vanes so that they, though stationary, instantaneously assume an apparent shape change as required for most efficiently handling the changed volume of fan air.

Controller 46 is actually determining what future air flow demand will need to pass through the diffuser vanes and will cause an apparent curvature change of the diffuser vanes to accept the new flow rate more efficiently.

Diffusers are present in a fan casing to aid in converting velocity head to static pressure or head. For diffusers vanes to operate correctly and efficiently, the entrance angle of the diffuser vane is designed so that the air leaving the rotor enters the diffuser vane at zero or small angle of attack. For a given rotor exit angle and fan speed, there is only one flow at which air enters the diffuser vane at optimum angle of attack. At off-design flow the angle of attack may be large enough to cause the vane to stall, thus generating shock looses in the passages between the vanes. These shock losses are such that the efficiency of the diffusers is usually less than that of the fan without diffusers. Mechanically adjusted vanes are known in the art for maintaining efficiency over a wide range of flow conditions, but are not altogether satisfactory from the standpoint of efficiency because complicated mechanical linkages necessary to change the vane angles are subject to high maintenance.

The above discussion of prior art applies to fans operating against a nearly constant pressure. The lift fans for supplying cushion air on surface effect ships operate against a continually fluctuating pressure and volume or flow demand. Consequently, the use of mechanically adjustable vanes becomes impractical because of the high frequency at which they need to be adjusted. Furthermore, there is a problem associated with pivoted diffuser vanes, because even at a new position, the curvature of the vanes do not change and some stalling may occur at a particular flow rate. This problem is illustrated in FIG. 6, where vane 54 is changed from position A to position B to meet changed flow conditions. While position B may be a preferred position for such a fixed curvature vane, stalling may still occur at the separation area on the back of the vane because the curvature is not right for that flow. In the present invention, the fan maintains a maximum efficiency for discharging air over the diffusers without stalling by the admission of pressurized fluid such as compressed air to the surface on the vanes as illustrated in FIGS. 7 and 8.

The embodiment of FIG. 7 illustrates a trailing edge provided with a slot 40 for establishing the Coanda effect as air flows therefrom. The air blown from this slot adheres to the surface around the trailing edge and remains attached to a point under the surface of the vane with a component for changing air flow thereround as illustrated as shown. In FIG. 8 the jet flap principle is illustrated by compressed air being blown from slot 42 directly downwardly along the underneath side of the vane for effecting an apparent curvature change to oncoming air.

As a result of air being blown from slots 40 or 42 from the hollow vanes, it will be apparent that the fan air stream is caused to curve in a manner as though the vanes were of a different shape. In essence, as far as the air stream is concerned, a fixed vane has taken on a different curvature. This vane curvature is subject to infinite and instantaneous effective change, depending only on the rate that compressed air is blown from the slots. By the arrangement disclosed, means are shown for changing the effective curvature of fixed diffuser vanes without the necessity of mechanical linkage, and thus imparting to the fan a higher efficiency over a wide range of flow requirements. By this arrangement the ride control of a surface effect ship may be instantaneously responsive to meet future conditions.

The principle of the invention has been disclosed. It will be apparent that various changes and deviations may be made from the disclosure without departing from the spirit of the invention. It is intended that the invention will be limited only by the scope of the claims appended hereto.

What is claimed is:

1. In a centrifugal fan including a rotor for supplying air under pressure at varying flow rate demands, the improvement comprising:

a cascade of curved hollow diffuser vanes fixedly disposed radially about the rotor for converting velocity head to static pressure in fan output air;

said fixed hollow diffuser vanes having openings communicating from their hollow interiors to their surfaces adjacent trailing edges thereof;

an independent source of pressurized fluid in communication with the hollow vanes for discharging fluid from said openings so as to effect an apparent curvature change of the diffuser vanes to fan air flowing thereover; and means sensing static pressure on opposite sides of the vanes and in response thereto instanteously controlling the amount of pressurized fluid discharging from the diffuser vanes to present an apparent curvature for most efficiently handling that flow rate.

2. In a centrifugal fan including a rotor and a cascade of curved diffuser vanes fixedly disposed about the rotor for converting velocity head to static pressure of fan air being delivered to a pressurized cushion beneath a surface effect ship at varying rates of flow for supporting the ship and maintaining it in proper ride control, an improvement comprising:

an independent source of pressurized fluid; and means responsive to impending flow rate demands by sensing pressure variations on opposite sides of the vanes and associated with the pressurized fluid for selectively discharging pressurized fluid from surfaces of the diffuser vanes in a manner and at a rate to instantaneously create an apparent curvature change on the diffuser vanes to air supplied by the fan for most efficiently handling that flow rate.

3. A ride control system for a surface effect ship comprising in combination:

a centrifugal fan for supplying air to a pressurized cushion in a plenum chamber beneath the surface effect ship at varying rates of flow for supporting the ship on cushion and for maintaining it in proper ride control;

said fan having a rotor;

a cascade of curved diffuser vanes disposed peripherally of the rotor for receiving air discharged from the rotor and converting its velocity head to static pressure;

said diffuser vanes being hollow and having passage means communicating with the exterior surfaces thereof;

a source of pressurized fluid in communication with the vanes interiors; and means responsive to flow requirements for maintaining the cushion in proper ride control;

said responsive means sensing pressure variations on opposite sides of the diffuser vanes and selectively admitting pressurized fluid from the source to interiors of said diffuser vanes for discharge from the passages at a rate for effecting an apparent curvature change on the vanes which curvature most efficiently handles the fan output necessary to meet the air flow requirements.

4. The method of improving efficiency of a centrifugal fan having a rotor which discharges air through a cascade of fixed curved diffuser vanes for converting velocity head to static pressure in air supplied downstream over a wide range of varying rates to meet flow demands comprising the steps of:

sensing pressure variations on opposite sides of the diffuser vanes; and responding to the sensed pressure by selectively permitting the ejection of pressurized fluid of an independent source from the surface of diffuser vanes at a rate for effecting an apparent curvature on the diffuser vane surfaces sufficient to most efficiently handle the flow rate to meet the demand.

* * * * *